US008160466B2

(12) United States Patent
Yamanaka et al.

(10) Patent No.: US 8,160,466 B2
(45) Date of Patent: Apr. 17, 2012

(54) FIXING DEVICE HAVING CONTROL UNIT FOR DETECTING PRESSURE CANCELLATION FAILURE OF PRESSURE ROLLER AGAINST HEATING ROLLER

(75) Inventors: Takashi Yamanaka, Osaka (JP); Atsushi Ide, Osaka (JP); Kimihide Tsukamoto, Osaka (JP); Hiroshi Nakatani, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 321 days.

(21) Appl. No.: 12/470,713

(22) Filed: May 22, 2009

(65) Prior Publication Data

US 2009/0297181 A1 Dec. 3, 2009

(30) Foreign Application Priority Data

May 27, 2008 (JP) ..... 2008-138182

(51) Int. Cl.
*G03G 15/20* (2006.01)

(52) U.S. Cl. ..... 399/67; 399/122; 399/331

(58) Field of Classification Search ..... 399/67, 399/320, 338, 335, 331, 330, 328, 44, 45, 399/122, 329, 339
See application file for complete search history.

(56) References Cited

U.S. PATENT DOCUMENTS 4,232,959 A * 11/1980 Ateya et al. ..... 399/67
5,732,309 A 3/1998 Okuno et al.
6,201,938 B1 * 3/2001 Hollar et al. ..... 399/67
2005/0196186 A1 * 9/2005 Suzuki ..... 399/45
2006/0002737 A1 * 1/2006 Shinshi ..... 399/122

FOREIGN PATENT DOCUMENTS

JP 9-230721 9/1997
JP 2003-091202 3/2003
JP 2003-280308 10/2003

* cited by examiner

*Primary Examiner* — David Porta
*Assistant Examiner* — Yara Green
(74) *Attorney, Agent, or Firm* — Renner, Otto, Boisselle & Sklar, LLP

(57) ABSTRACT

In one embodiment of the present invention, a fixing apparatus that causes a recording material to pass through a nip portion formed by a rotating heat roller and a rotating pressure roller being in contact so as to perform a fixing operation is configured including a pressing mechanism that can switch between a pressure applied state in which the pressure roller presses against the heat roller using a bias and a pressure cancelled state in which the pressure is cancelled, a pressure state detection unit, and a control unit that performs a pressure cancelation operation and a pressure application operation. If the pressure state detection unit does not detect the pressure cancelled state even when the control unit has performed pressure cancellation control for a certain time period with respect to the pressing mechanism in the pressure applied state, the control unit permits a fixing operation in only the pressure applied state after performing pressure application control for a certain time period with respect to the pressing mechanism.

6 Claims, 9 Drawing Sheets

FIXING DEVICE HAVING CONTROL UNIT FOR DETECTING PRESSURE CANCELLATION FAILURE OF PRESSURE ROLLER AGAINST HEATING ROLLER

BACKGROUND OF THE INVENTION

This application claims priority under 35 U.S.C. §119(a). on Patent Application No. 2008-138182 filed in Japan on May 27, 2008, the entire contents of which are herein incorporated by reference.

The present invention relates to a fixing apparatus used in an image forming apparatus and the like.

In an image forming apparatus and the like using an electrophotographic method that is widely applied in copying machines, laser printers, facsimiles, and the like, conventionally, a fixing method used in a fixing apparatus is generally a heat fixing method. For such a heat fixing method, a heat roller fixing method using a heat roller is generally applied.

With the heat roller fixing method, a heat roller including an internal heater as a heat source and an external surface covered with rubber or resin having good releasability, and a pressure roller are pressed against each other so that a nip portion is formed between these rollers. Then, a transfer paper on which a toner image has been formed is caused to pass through the nip portion so that the toner is heated and melted. Thereby, the toner is fused and fixed onto the transfer paper. The heat roller fixing method is suitable for increasing speeds because the entire heat roller is maintained at a predetermined temperature.

In the fixing apparatus using the aforementioned heat roller and pressure roller, the pressure roller is pressed against the heat roller so that a fixing operation is reliably performed. However, in the image forming apparatus using the aforementioned fixing apparatus, when warming up or being on standby, operations in the image forming apparatus having been stopped, or the like, if the pressure roller is maintained for a long time in a state in which the pressure roller is pressing against the heat roller, the surface of the heat roller or the like may possibly be deformed.

Thus, if the time period when the fixing apparatus does not perform a fixing operation is of a certain length, pressure applied by the pressure roller against the heat roller is cancelled so that the high quality performance of the fixing apparatus can be maintained. Accordingly, in the fixing apparatus using the heat roller and the pressure roller, a pressing means capable of switching between a pressure applied state in which the pressure roller is pressed against the heat roller and a pressure cancelled state in which such pressure is cancelled is generally used (for example, see JP 2003-280308A).

In the fixing apparatus including the aforementioned pressing means, a pressure cancelation operation and a pressure application operation are performed using the pressing means. The pressure cancelation operation is an operation for shifting from the pressure applied state to the pressure cancelled state with respect to the pressing means in the pressure applied state. On the contrary, the pressure application operation is an operation for shifting from the pressure cancelled state to the pressure applied state with respect to the pressing means in the pressure cancelled state.

In the aforementioned fixing apparatus, when the pressing means enters a state in which either the pressure cancelation operation or the pressure application operation cannot be performed, in general, the fixing apparatus determines that a failure has occurred in the pressing means and performs processing for stopping operations in the fixing apparatus in either case.

In the aforementioned fixing apparatus, when the pressure application operation cannot be performed, that is, an operation for shifting from the pressure cancelled state to the pressure applied state cannot be performed with respect to the pressing means in the pressure cancelled state, a state in which the pressure roller cannot press against the heat roller surely maintains. Accordingly, if the aforementioned fixing apparatus is caused to operate in such a state, a fixing operation cannot be reliably performed.

However, when the pressure cancelation operation cannot be performed, that is, an operation for shifting from the pressure applied state to the pressure cancelled state cannot be performed with respect to the pressing means in the pressure applied state, the pressure roller remains pressing against the heat roller.

Accordingly, if the aforementioned fixing apparatus is caused to operate in such a state, a fixing operation can reliably be performed. Consequently, even when it is determined that a failure has occurred in the aforementioned pressing means, it is still possible to perform a fixing operation depending on the state of the pressing means. Thus, there has been a demand for a fixing apparatus for such a situation.

SUMMARY OF THE INVENTION

In view of this, this invention was achieved in order to handle circumstances such as described above and intends to provide a fixing apparatus that can perform a fixing operation depending on the state of the pressing means even when it is determined that a failure has occurred in a pressing means of the fixing apparatus, thus enabling an increase in convenience for the user.

The fixing apparatus of the present invention is a fixing apparatus that causes a recording material to pass through a nip portion formed by a rotating heat roller and a rotating pressure roller being in contact so as to perform a fixing operation to fix an unfixed image on the recording material.

This fixing apparatus includes a pressing mechanism, a pressure state detection unit, and a control unit. Of these, the pressing mechanism is configured so as to be capable of switching between a pressure applied state in which a pressure roller presses against a heat roller using a bias and a pressure cancelled state in which the pressure is cancelled. The pressure state detection unit is a unit that detects the pressure applied state and the pressure cancelled state of the pressing mechanism.

The control unit is a unit that performs pressure cancellation control and pressure application control. Of these, pressure cancellation control is control according to which the pressing mechanism in the pressure applied state is shifted from the pressure applied state to the pressure cancelled state within a certain time period. On the contrary, pressure application control is control according to which the pressing mechanism in the pressure cancelled state is shifted from the pressure cancelled state to the pressure applied state within substantially the same time period as the aforementioned certain time period.

In the aforementioned fixing apparatus, if the pressure state detection unit does not detect the pressure cancelled state even when the control unit has performed pressure cancellation control for a certain time period with respect to the pressing mechanism in the pressure applied state, the control unit determines that a pressure cancellation failure has occurred. Then, the control unit permits a fixing operation in only the pressure applied state after performing pressure application control for substantially the aforementioned certain time period with respect to the pressing mechanism.

In the aforementioned fixing apparatus, if the pressure state detection unit does not detect the pressure cancelled state even when the control unit performed pressure cancellation control for a certain time period with respect to the pressing mechanism in the pressure applied state, the control unit determines that a pressure cancellation failure has occurred; however, the control unit permits a fixing operation in only the pressure applied state after performing pressure application control for substantially the aforementioned certain time period with respect to the pressing mechanism. The following are the reasons why the above operation is permitted in only such a state.

If the pressure state detection unit does not detect the pressure cancelled state even when the control unit has performed pressure cancellation control for a certain time period with respect to the pressing mechanism in the pressure applied state, such a case can be considered as a case of the pressing mechanism being inoperative or the pressure state detection unit failing to detect, or a failure having occurred due to both the inoperability of the pressing mechanism and a detection failure in the pressure state detection unit.

First, in the aforementioned case of inoperability of the pressing mechanism, the pressure state detection unit is normal. In this case, since the pressing mechanism does not operate, even when the control unit performed pressure cancellation control for a certain time period, the pressing mechanism remains in the pressure applied state and cannot shift to the pressure cancelled state. As a result of this, the pressure state detection unit is normal, but cannot detect the pressure cancelled state of the pressing mechanism.

That is, since the pressing mechanism does not operate in this case, even if the control unit performs pressure application control for substantially the aforementioned certain time period after performing pressure cancellation control, the pressing mechanism does not operate, remaining in the pressure applied state. Accordingly, in this case, the aforementioned fixing apparatus can perform a fixing operation because the pressure roller remains pressing against the heat roller.

Next, in the case of a detection failure in the pressure state detection unit, the pressing mechanism is normal. In this case, the pressing mechanism operates, shifts from the pressure applied state to the pressure cancelled state, and enters the pressure cancelled state. However, the pressure cancelled state cannot be detected because the pressure state detection unit fails.

That is, in this case, since the pressing mechanism is normal and can operate, if the control unit performs pressure application control for substantially the aforementioned certain time period after performing pressure cancellation control, the pressing mechanism returns to the pressure applied state that was the previous state thereof. Consequently, in this case, the state returns to a state in which the pressure roller presses against the heat roller; thus, the aforementioned fixing apparatus can perform a fixing operation.

Next, if both the aforementioned inoperability of the pressing mechanism and a detection failure in the pressure state detection unit concurrently occur, the pressing mechanism does not operate in this case; thus, even when the control unit has performed pressure cancellation control for a certain time period, the pressing mechanism remains in the pressure applied state and cannot shift to the pressure cancelled state. Also, the pressure cancelled state is not detected because the pressure state detection unit fails.

That is, this case is the same as the aforementioned case of inoperability of the pressing mechanism because the pressing mechanism does not operate. Thus, even if the control unit performs pressure application control for substantially the aforementioned certain time period after performing pressure cancellation control, the pressing mechanism remains in the pressure applied state. Consequently, the pressure roller remains pressing against the heat roller in this case; thus, the aforementioned fixing apparatus can perform a fixing operation.

According to the aforementioned fixing apparatus, if the pressure state detection unit does not detect the pressure cancelled state even when pressure cancellation control was performed for a certain time period with respect to the pressing mechanism in the pressure applied state, it is determined that a pressure cancellation failure has occurred; however, a fixing operation in only the pressure applied state is permitted after pressure application control is performed for substantially the aforementioned certain time period with respect to the pressing mechanism.

As a result, even when it is determined that a pressure cancellation failure has occurred in the pressing mechanism of the fixing apparatus, a fixing operation can be performed. Therefore, the convenience for a user of an image forming apparatus or the like including the aforementioned fixing apparatus as a constituent element can be increased.

In the fixing apparatus including a function of determining whether the aforementioned pressure cancellation failure has occurred, on determining the occurrence of a pressure cancellation failure, the control unit may output information indicating "a failure occurred" and "a fixing operation can be performed in only the pressure applied state".

Accordingly, as for the image forming apparatus including the aforementioned fixing apparatus as a constituent element, based on the aforementioned information, the user of this image forming apparatus can be notified with the exact state of the image forming apparatus. Further, the user can request a store or the like that sold the image forming apparatus to send maintenance personnel, or the like. Therefore, the convenience for the user using the image forming apparatus including the aforementioned fixing apparatus as a constituent element can be increased.

In the aforementioned fixing apparatus including the pressing mechanism, the pressure state detection unit, and the control unit, if the pressure state detection unit does not detect the pressure applied state even when the control unit has performed pressure application control for substantially the aforementioned certain time period with respect to the pressing mechanism in the pressure cancelled state, it is preferable that the control unit determines that a pressure application failure has occurred and does not permit a fixing operation.

In the aforementioned fixing apparatus, if the pressure state detection unit does not detect the pressure applied state even when the control unit has performed pressure application control for substantially the aforementioned certain time period with respect to the pressing mechanism in the pressure cancelled state, such a case can be considered as a case of the pressing mechanism being inoperative or the pressure state detection unit failing to detect, or a failure having occurred due to both the inoperability of the pressing mechanism and a detection failure in the pressure state detection unit.

When the pressing mechanism is normal, but the pressure state detection unit fails to detect, the control unit can cause the pressing mechanism to enter the pressure applied state by performing pressure application control for substantially the aforementioned certain time period with respect to the pressing mechanism. In this case, the pressure roller definitely presses against the heat roller; thus, the aforementioned fixing apparatus can perform a fixing operation.

However, in the case of the pressing mechanism being inoperative, although the pressure state detection unit is normal, the pressing mechanism does not operate. Accordingly, even when the control unit has performed pressure application control for substantially the aforementioned certain time period, the pressing mechanism remains in the pressure cancelled state and cannot shift to the pressure applied state. Consequently, the pressure state detection unit is normal, but cannot detect the pressure applied state of the pressing mechanism.

That is, in this case, since the pressing mechanism does not operate, the pressing mechanism remains in the pressure cancelled state even after the control unit has performed pressure application control. Accordingly, in this case, the pressure roller is not pressing against the heat roller; thus, the aforementioned fixing apparatus cannot perform a fixing operation.

That is, if the pressing mechanism is normal, but the pressure state detection unit fails to detect, the control unit can cause the pressing mechanism to enter the pressure applied state by performing pressure application control for substantially the aforementioned certain time period with respect to the pressing mechanism. Thus, a fixing operation can be performed in this case. However, if the pressing mechanism is inoperative, since the pressing mechanism does not operate, the pressing mechanism remains in the pressure cancelled state no matter what processing the control unit performs. Consequently, a fixing operation cannot be performed in this case.

However, in the above case, the control unit cannot determine which case is occurring, that is, whether the pressure state detection unit fails to detect although the pressing mechanism is normal, or the pressing mechanism is inoperative. Therefore, in the aforementioned case in which the pressure state detection unit does not detect the pressure applied state even when the control unit performed pressure application control for substantially the aforementioned certain time period with respect to the pressing mechanism in the pressure cancelled state, the control unit determines that a pressure application failure has occurred and does not permit a fixing operation as a precaution. That is the only method for handling such a case. Therefore, the control unit determines that a pressure application failure has occurred and does not permit a fixing operation in this case.

According to the aforementioned fixing apparatus, if the pressure state detection unit does not detect the pressure applied state even when pressure application control was performed for substantially the aforementioned certain time period with respect to the pressing mechanism in the pressure cancelled state, it is determined that a pressure application failure has occurred, and a fixing operation is not permitted. Accordingly, a case in which it is determined that a pressure application failure has occurred in the pressing mechanism of the fixing apparatus can be reliably determined as a case in which a fixing operation cannot be performed. Therefore, the convenience for the user of the image forming apparatus or the like including the aforementioned fixing apparatus as a constituent element can be increased.

In the fixing apparatus including a function of determining whether the aforementioned pressure application failure has occurred, on determining the occurrence of a pressure application failure, the control unit may output information indicating "a failure occurred" and "a fixing operation cannot be performed".

Accordingly, as for the image forming apparatus including the aforementioned fixing apparatus as a constituent element, based on the aforementioned information, the user using this image forming apparatus can be notified with the exact state of the image forming apparatus. Further, the user can request a store or the like that sold the image forming apparatus to send maintenance personnel, or the like. Therefore, the convenience for the user of the image forming apparatus including the aforementioned fixing apparatus as a constituent element can be increased.

According to the present invention, in the fixing apparatus, if the pressure state detection unit does not detect the pressure cancelled state even when pressure cancellation control was performed for a certain time period with respect to the pressing mechanism in the pressure applied state, it is determined that a pressure cancellation failure has occurred; however, a fixing operation in only the pressure applied state is permitted after pressure application control is performed for substantially the aforementioned certain time period with respect to the pressing mechanism.

As a result, even when it is determined that a pressure cancellation failure has occurred in the pressing mechanism of the fixing apparatus, a fixing operation can be performed. Therefore, the convenience for the user of the image forming apparatus or the like including the aforementioned fixing apparatus as a constituent element can be increased.

DESCRIPTION OF THE PREFERRED EMBODIMENTS

Figure 1:
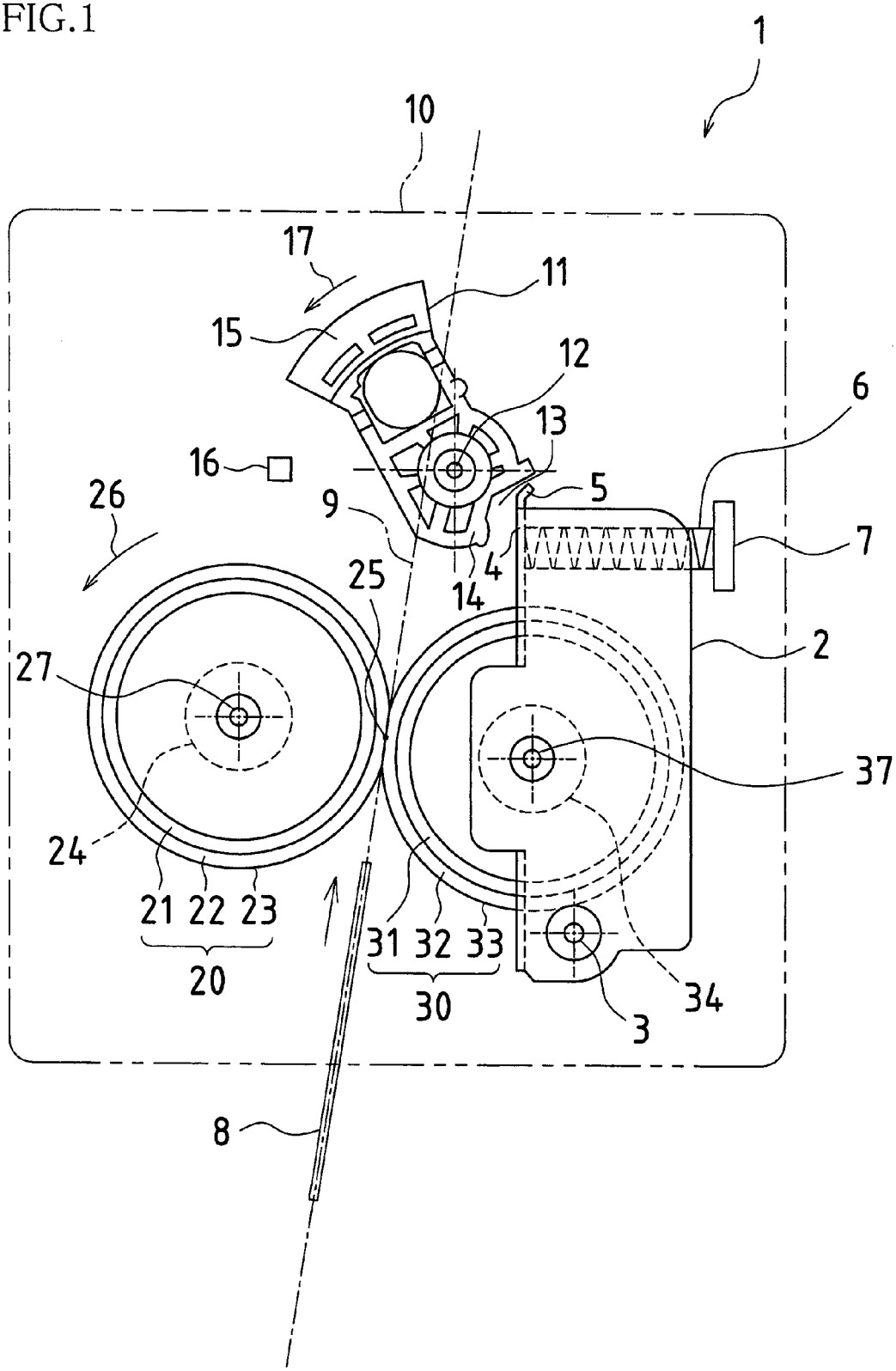
FIG. 1 is a configuration diagram showing the configuration of a fixing apparatus in an embodiment.

Next, a fixing apparatus in an embodiment of the present invention will be described with reference to the drawings. FIG. 1 is a configuration diagram showing the configuration of a fixing apparatus 1 in the present embodiment. In FIG. 1, the fixing apparatus 1 in the present embodiment is mainly configured of a heat roller 20 and a pressure roller 30, which form a pair of rotary bodies, a pressure roller holder 2, a spring 6, a pressure control lever (cam) 11, a sensor 16, and a fixing apparatus chassis 10. The aforementioned pressing mechanism is mainly configured of a combination of the pressure roller holder 2, the spring 6, and the pressure control lever 11 among the above components.

Note that, in FIG. 1, the fixing apparatus chassis 10 is formed in front of the heat roller 20, the pressure roller 30, the pressure roller holder 2, the spring 6, the pressure control lever 11, the sensor 16, and the like, and the fixing apparatus chassis 10 is indicated with an imaginary line in FIG. 1. Also, looking at FIG. 1, the left side represents the front and the right side represents the back in FIG. 1.

The fixing apparatus 1 in the present embodiment presses the pressure roller 30 against the heat roller 20 so as to form a nip portion 25, which is a contact region of both rollers; causes a recording paper 8, on which toner forming a visible image has been transferred, to pass through the nip portion 25; and melts the toner on the recording paper 8 using heat from the heat roller 20 and pressure from the pressure roller 30 so as to fix the image on the recording paper 8. The recording paper 8 is transported from the bottom to the top of FIG. 1 along a recording paper transport path 9.

A heat roller support shaft 27 of the heat roller 20 is rotatably attached to the fixing apparatus chassis 10 so that the heat roller 20 rotates due to a motor (not shown) in the direction indicated by an arrow 26.

The heat roller 20 includes a metal core 21, an elastic body layer 22, and a surface layer 23. A highly thermally conductive metal can be used for the metal that forms the metal core 21, and examples of such metals include aluminum, iron, and the like. Although a shape of the metal core 21 can be cylindrical, cylindraceous, or the like, the shape is preferably cylindrical with the amount of heat discharged from the metal core 21 being small.

Although a material constituting the elastic body layer 22 is not particularly limited as long as the material has rubber elasticity, it is preferable that the material furthermore has high thermal resistance as well. Specific examples of such a material include, for example, silicone rubber, fluoro rubber, fluorosilicone rubber, and the like. Particularly, silicone rubber that has great rubber elasticity is preferable among these.

A material constituting the surface layer 23 is not particularly limited as long as the material has high thermal resistance and durability, and toner tends not to adhere to the material. Examples of such a material include a fluoroplastic material, such as PFA (tetrafluoroethylene-perfluoroalkylvinylether copolymer) or PTFE (polytetrafluoroethylene), fluoro rubber, and the like. In the present embodiment, the surface layer 23 is a PFA layer having a thickness of approximately 40 μm.

A pressure roller support shaft 37 of the pressure roller 30 is rotatably attached in the vicinity of the center of the pressure roller holder 2 so that the pressure roller 30 can freely rotate with respect to the pressure roller holder 2. The pressure roller 30 contacts the rotating heat roller 20 and is driven to rotate due to this contact.

When the heat roller 20 fixes a toner image onto the recording paper 8 by heating, the pressure roller 30 presses the melting toner against the recording paper 8 so as to facilitate fixing of the toner image onto the recording paper 8.

The pressure roller 30 includes a metal core 31, an elastic body layer 32, and a surface layer 33. The same metal or materials that form the metal core 21, the elastic body layer 22, and the surface layer 23 of the heat roller 20 can be respectively used for materials that form the metal core 31, the elastic body layer 32, and the surface layer 33. Also, the shape of the metal core 31 is the same as that of the metal core 21 of the heat roller 20.

Heaters 24 and 34 are provided inside the aforementioned heat roller 20 and pressure roller 30. In the present embodiment, halogen lamps are used for the heaters 24 and 34. The heaters 24 and 34 heat the heat roller 20 and the pressure roller 30. Further, in order to maintain a uniform temperature on the surfaces of the heat roller 20 and the pressure roller 30, temperature sensors (not shown) configured of a thermistor or the like are provided close to the heat roller 20 and the pressure roller 30. The temperatures of the surfaces of the heat roller 20 and the pressure roller 30 are measured using such temperature sensors so that the heaters 24 and 34 are controlled.

The pressure roller holder 2 supports the pressure roller 30 as described above. Note that, as for the pressure roller holder 2, the side where the pressure roller holder 2 is close to the heat roller 20 is referred to as a front side of the pressure roller holder 2 and the opposite side to the front side of the pressure roller holder 2 is referred to as a rear side of the pressure roller holder 2.

The pressure roller holder 2 is provided with a holder support shaft 3 in a position that is on the lower part of the pressure roller holder 2 and is obliquely closer to the lower rear side with respect to the pressure roller support shaft 37. The holder support shaft 3 is turnably attached to the fixing apparatus chassis 10. That is, the pressure roller holder 2 turns with the holder support shaft 3 as a fulcrum. Accordingly, the entire pressure roller 30 turns with the holder support shaft 3 as a fulcrum.

A holder upper portion piece 4 is formed on the upper front side of the pressure roller holder 2, and the upper end thereof bends toward the rear side so as to form a holder upper portion piece end 5. Further, the end of the spring 6 whose base end is fixed with a spring support piece 7 presses against the back face of the holder upper portion piece 4 of the pressure roller holder 2. The spring support piece 7 is fixed on the fixing apparatus chassis 10.

The above spring 6 causes the pressure roller holder 2 to be biased toward the heat roller 20. Since the pressure roller 30 is attached to the pressure roller holder 2, the pressure roller 30 presses against the heat roller 20 due to this bias. The pressure roller 30 presses against the heat roller 20 so that a toner image on the recording paper 8, which passes through the nip portion 25 between the heat roller 20 and the pressure roller 30, can be reliably fixed. The state of the pressure roller 30 in this state is the aforementioned pressure applied state.

As described above, as for the fixing apparatus 1 using the heat roller 20 and the pressure roller 30, in an image forming apparatus and the like using the fixing apparatus 1, when warming up or being on standby, operations in the image forming apparatus having been stopped, or the like, if the pressure roller 30 is maintained for a long time in a state in which the pressure roller 30 is pressing against the heat roller 20, the surface of the heat roller 20 may possibly be deformed. Alternatively, if toner forming a visible image is to be transferred onto an envelope or the like that is thicker than the recording paper 8, excessive force may be exerted onto the envelope or the like in the state in which pressure roller 30 is pressing against the heat roller 20 so that, for example, the envelope or the like may be crumpled.

In view of this, when the fixing apparatus 1 does not perform a fixing operation for a certain time period, or a toner image formed on an envelop or the like is fixed, pressure applied by the pressure roller 30 against the heat roller 20 can be cancelled so as to maintain the high quality performance of the fixing apparatus 1. That is, providing a mechanism capable of switching the state of the pressure roller 30 between the aforementioned pressure applied state and pressure cancelled state with respect to the heat roller 20 is superior in terms of maintaining the high quality performance of the fixing apparatus 1.

Accordingly, the pressure control lever 11 is used in the aforementioned fixing apparatus 1 in order to switch the state of the pressure roller 30 between the pressure applied state and the pressure cancelled state with respect to the heat roller 20.

The pressure control lever 11 is provided close to the pressure roller holder 2 in a position that is obliquely up toward the front relative to the pressure roller holder 2. The shape of the pressure control lever 11 is similar to a shape constituted from the upper half of a fan shape and the bottom thereof is connected to a plate piece including a plurality of notches that is coarse mesh-shaped. The pressure control lever 11 includes a pressure control lever support shaft 12 on the plate piece portion that is opposite the upper half of the fan shape with the center portion of the pressure control lever 11 therebetween, and the pressure control lever support shaft 12 is turnably attached to the fixing apparatus chassis 10.

As for the pressure control lever 11, the pressure control lever support shaft 12 of the pressure control lever 11 is connected to a pressure control lever drive motor (not shown). Accordingly, the pressure control lever drive motor rotates forward or backward so that the pressure control lever 11 can freely turn with the pressure control lever support shaft 12 as a fulcrum. Note that, in FIG. 1, an arrow 17 indicates a forward rotational direction when the pressure control lever 11 turns.

Also, as can be seen from FIG. 1, on the edge portion of the plate piece portion of the pressure control lever 11, a pressure control lever notch portion 13 and a pressure control lever projecting portion 14 are adjacently formed next to each other in an order corresponding to the clockwise (CW) direction of the pressure control lever support shaft 12 as a fulcrum.

Further, the fan-shaped portion of the pressure control lever 11 is formed as a sensor light reflection piece 15. The sensor light reflection piece 15, as described later, is used to reflect infrared rays irradiated by the sensor 16 when the pressure control lever 11 turns so that the sensor light reflection piece 15 is moved to a position in which the sensor light reflection piece 15 faces the sensor 16.

In the aforementioned fixing apparatus 1, by turning the pressure control lever 11 in the forward rotational direction or in the backward rotational direction, a pressure cancelation operation for shifting from the pressure applied state to the pressure cancelled state and a pressure application operation for shifting from the pressure cancelled state to the pressure applied state are performed so as to perform the above switching.

The state of the pressure control lever 11 as shown in FIG. 1 indicates the pressure applied state. In this state, the position of the pressure control lever 11 is determined so that the holder upper portion piece end 5 of the pressure roller holder 2 is positioned in a space formed in a depressed portion of the pressure control lever notch portion 13 of the pressure control lever 11 (note, also see FIG. 3 for the pressure applied state).

In the pressure applied state, being different from the case of the later-described pressure cancelled state, the tip of the pressure control lever projecting portion 14 of the pressure control lever 11 does not press the surface of the holder upper portion piece 4 of the pressure roller holder 2 or the holder upper portion piece end 5 of the pressure roller holder 2. That is, no force pressing the surface of the holder upper portion piece 4 of the pressure roller holder 2 or the holder upper portion piece end 5 of the pressure roller holder 2 is exerted at all onto the pressure roller holder 2.

Therefore, the biasing force provided by the spring 6 is directly conveyed to the pressure roller 30 via the pressure roller holder 2 so that a state in which the pressure roller 30 presses against the heat roller 20 due to the biasing force provided by the spring 6, that is, the pressure applied state is formed. Further, in the pressure applied state, the sensor light reflection piece 15 of the pressure control lever 11 is not in a position in which the sensor light reflection piece 15 faces the sensor 16.

Figure 4:
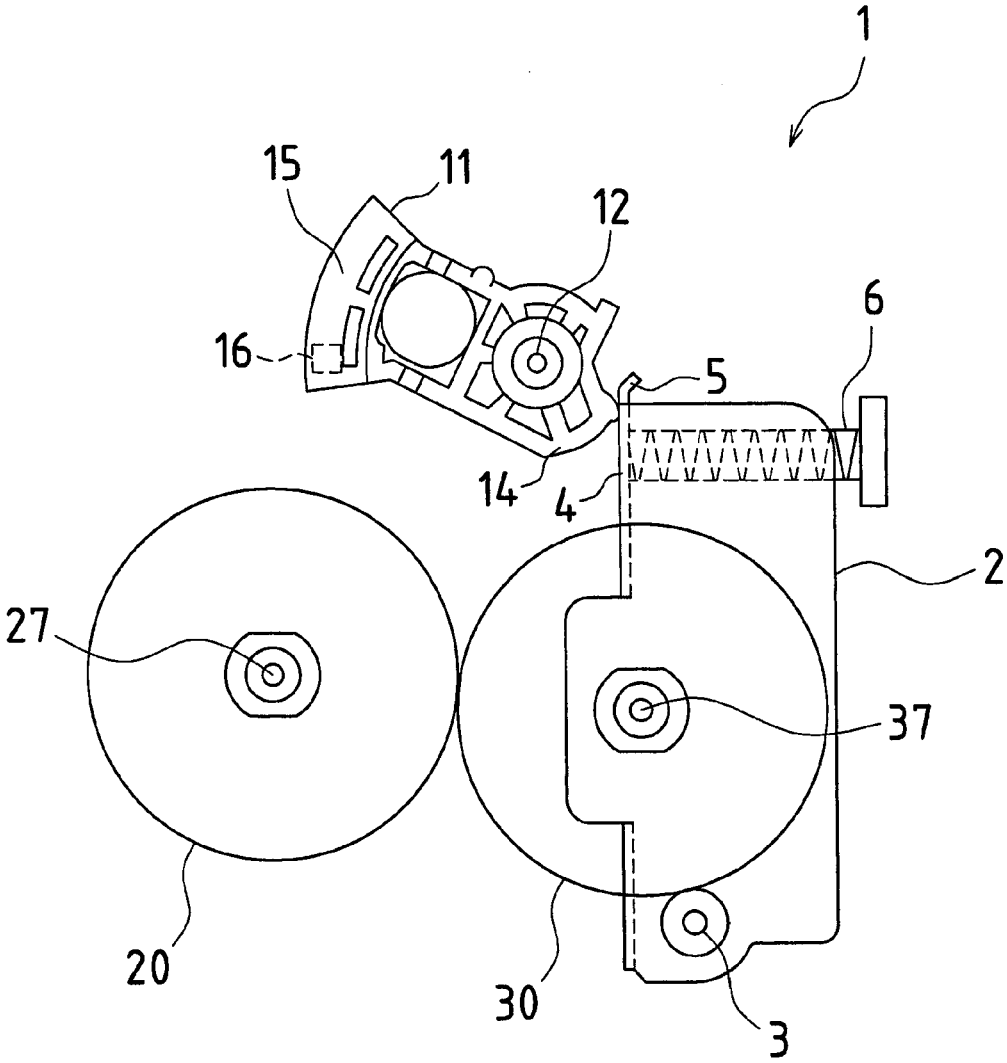
FIG. 4 is a third diagram illustrating the pressure cancelation operation and the pressure application operation performed by the fixing apparatus in the embodiment.
Figure 5:
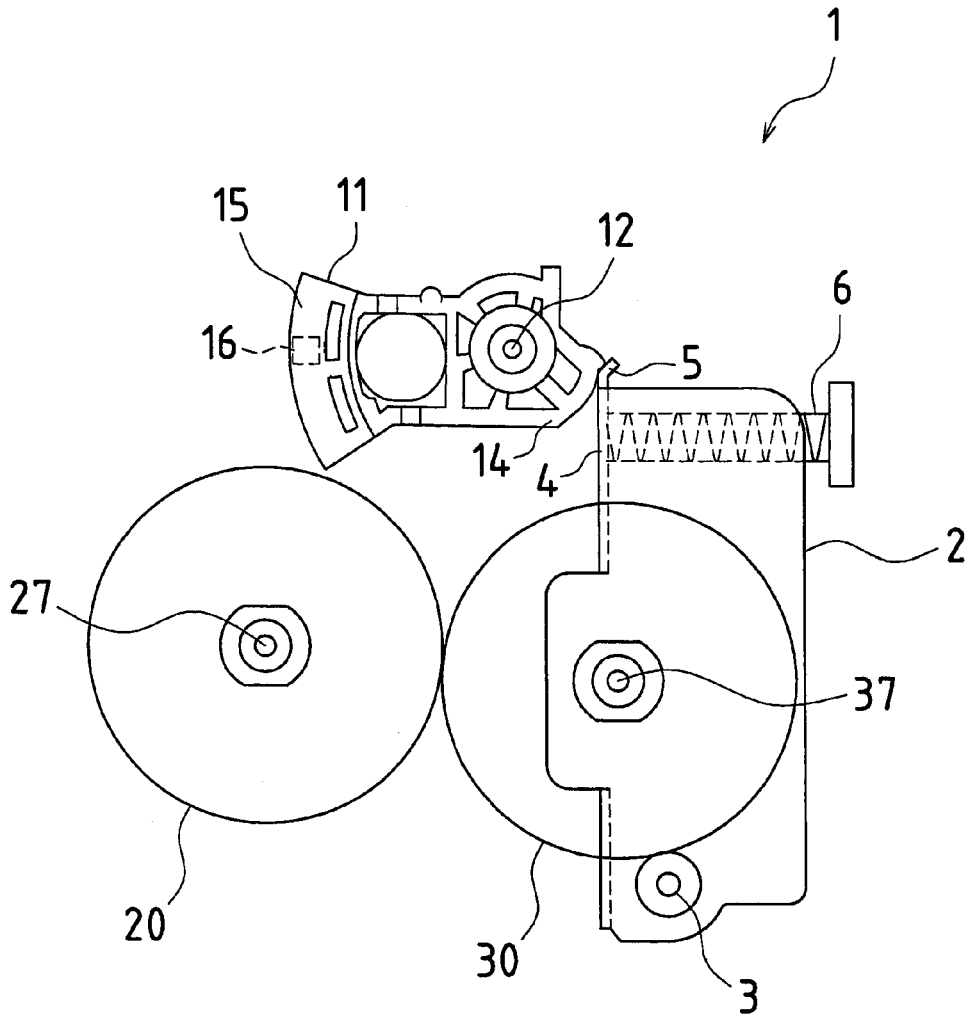
FIG. 5 is a fourth diagram illustrating the pressure cancelation operation and the pressure application operation performed by the fixing apparatus in the embodiment.

On the contrary, in the pressure cancelled state, the tip of the pressure control lever projecting portion 14 of the pressure control lever 11 presses the surface of the holder upper portion piece 4 of the pressure roller holder 2 or the holder upper portion piece end 5 of the pressure roller holder 2 (see FIGS. 4 and 5). Due to this pressure, the pressure roller holder 2 is slightly pressed backward so that the pressure applied by the pressure roller 30 with respect to the heat roller 20 is reduced. In the pressure cancelled state, the sensor light reflection piece 15 of the pressure control lever 11 moves to the aforementioned position in which the sensor light reflection piece 15 faces the sensor 16.

The sensor 16 is configured of an infrared ray emitting element and a light receiving element that receives reflected light. That reflected light is an infrared ray that has been emitted by the infrared ray emitting element, reflected on the sensor light reflection piece 15 of the pressure control lever 11, and returned. Note that, a proximity sensor and the like can be used for the sensor 16.

The sensor 16 enters a state in which the light receiving element receives reflected light reflected on the sensor light reflection piece 15 when the sensor light reflection piece 15 of the pressure control lever 11 moves to the position in which the sensor light reflection piece 15 faces the sensor 16. Such reflected light is received, as described above, when the state thereof is the pressure cancelled state, and the sensor output of the sensor 16 is at an "H (high) level". That is, when the sensor output of the sensor 16 is at the "H level", that state indicates that the sensor 16 is detecting the pressure cancelled state.

On the contrary, reflected light is not received in the pressure applied state as described above; thus, the sensor output of the sensor 16 is at an "L (low) level". That is, when the sensor output of the sensor 16 is at the "L level", that state indicates that the sensor 16 is detecting the pressure applied state.

Next, in the aforementioned fixing apparatus 1, the pressure cancelation operation for shifting from the pressure applied state to the pressure cancelled state and the pressure application operation for shifting from the pressure cancelled state to the pressure applied state are described based on the diagrams illustrating an operation shown in FIGS. 2 to 5 and the time charts shown in FIGS. 6A, 6B, 6C and 7A, 7B, 7C.

Figure 2:
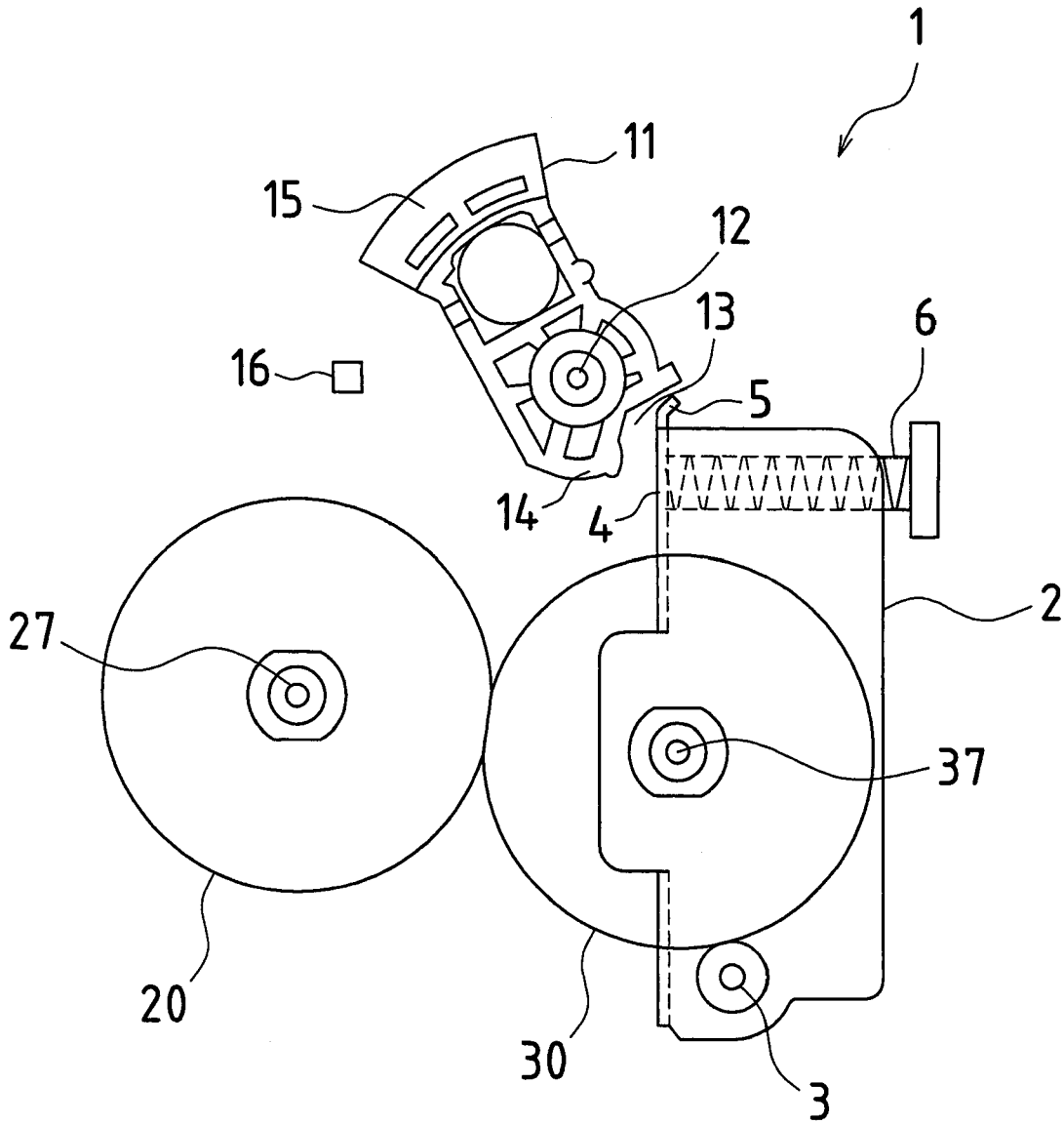
FIG. 2 is a first diagram illustrating a pressure cancelation operation and a pressure application operation performed by the fixing apparatus in the embodiment.

Note that the fixing apparatus chassis 10 is omitted, and part of the fixing apparatus 1 is simplified in the diagrams illustrating an operation shown in FIGS. 2 to 5. The state as shown in FIG. 2 is exactly the same as that shown in FIG. 1 and indicates the pressure applied state.

Figures 6A, 6B, 6C:
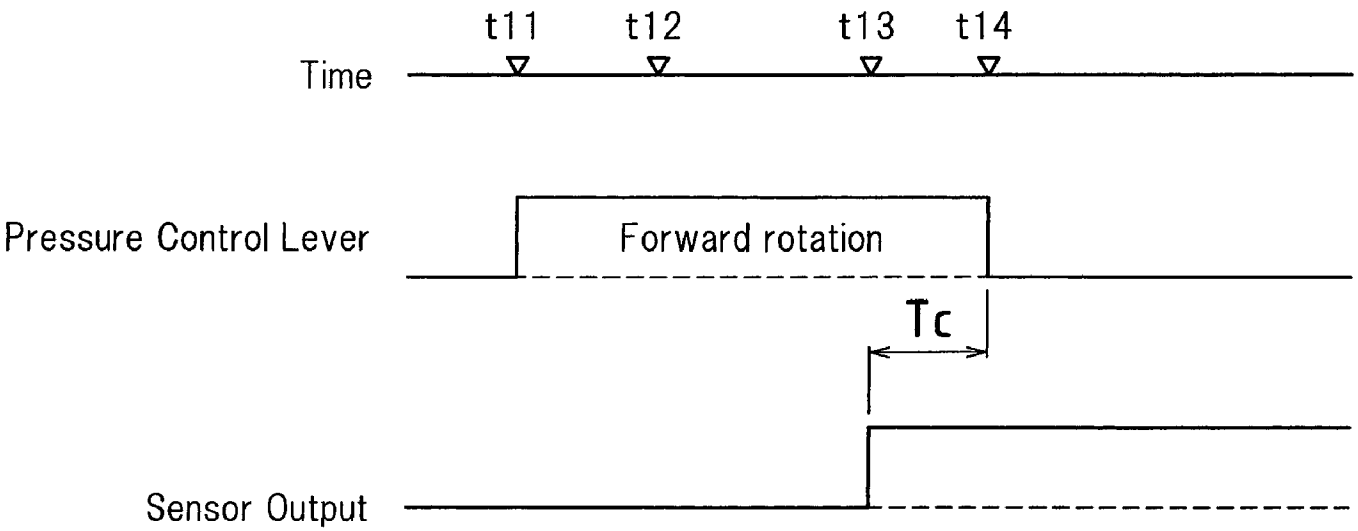
FIGS. 6A, 6B, and 6C is a time chart of pressure cancellation control performed by the fixing apparatus in the embodiment.
Figures 7A, 7B, 7C:
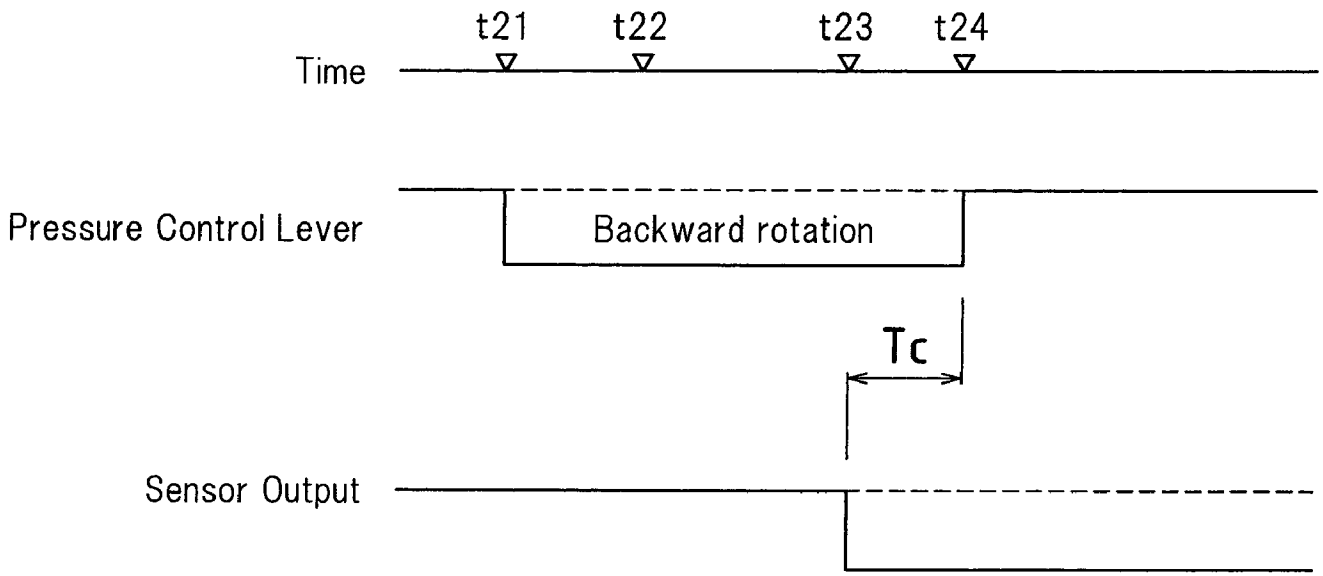
FIGS. 7A, 7B, and 7C is a time chart of pressure application control performed by the fixing apparatus in the embodiment.

A control unit (not shown) performs the aforementioned pressure cancelation operation and pressure application operation based on a signal from the sensor 16 by rotating the pressure control lever drive motor forward or backward so as to turn the pressure control lever 11 in the forward direction or in the backward direction. Control of the pressure cancelation operation by the control unit is referred to as pressure cancellation control, and control of the pressure application operation is referred to as pressure application control. FIGS. 6A, 6B, 6C shows a time chart of pressure cancellation control, and FIGS. 7A, 7B, 7C shows a time chart of pressure application control.

First, when the fixing apparatus 1 is in the pressure applied state, pressure cancellation control for shifting from the pressure applied state to the pressure cancelled state will be described. FIG. 2 shows the pressure applied state of the fixing apparatus 1. In this state, the output of the sensor 16 is at the "L level". In this state, the control unit rotates the pressure control lever drive motor forward so as to turn the pressure control lever 11 in the forward rotational direction (the direction indicated by the arrow 17 in FIG. 1) (t11 in FIG. 6A).

Figure 3:
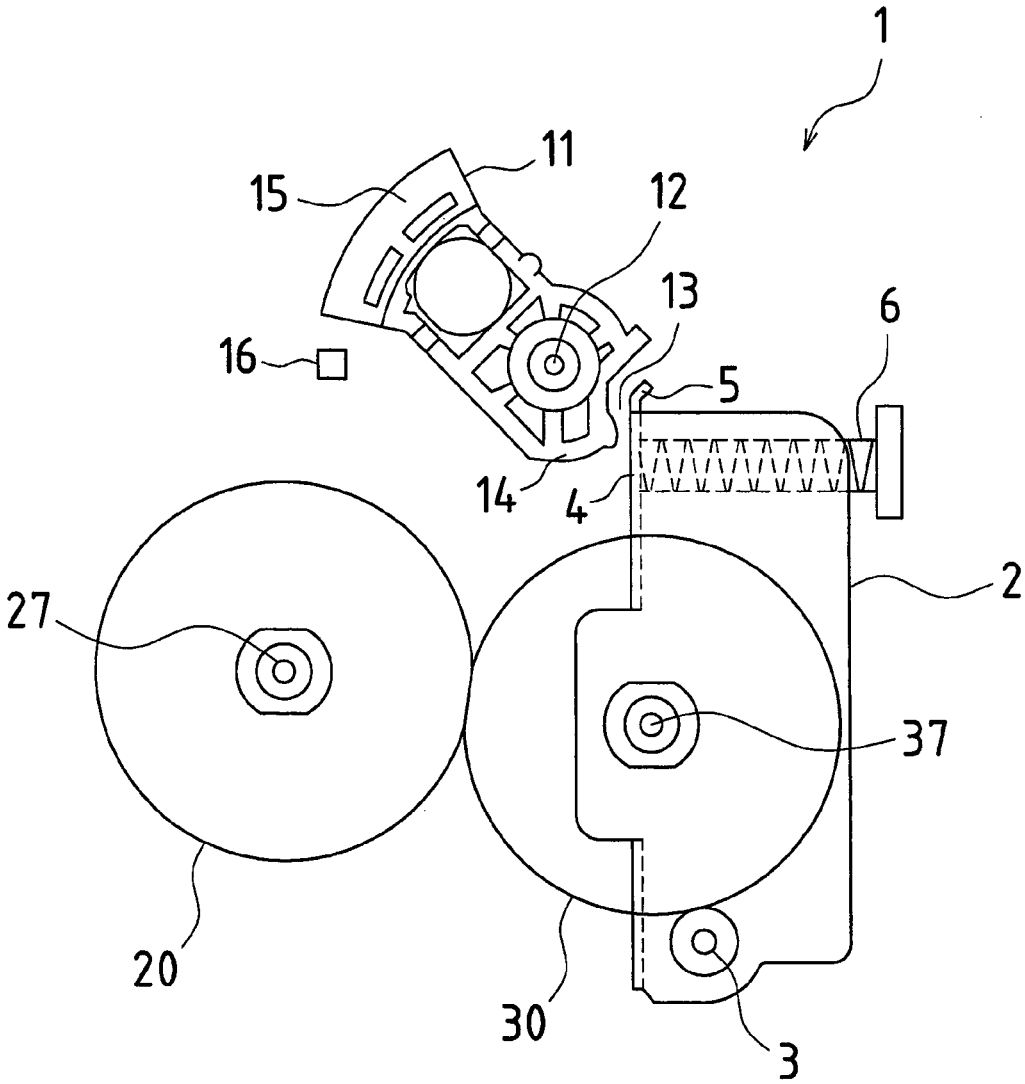
FIG. 3 is a second diagram illustrating the pressure cancelation operation and the pressure application operation performed by the fixing apparatus in the embodiment.

Thereby, the pressure control lever 11 turns in the forward rotational direction so as to enter the state as shown in FIG. 3 (t12 in FIG. 6A). In this state, since the tip of the pressure control lever projecting portion 14 of the pressure control lever 11 is not pressing the surface of the holder upper portion piece 4 of the pressure roller holder 2, the fixing apparatus 1 is still in the pressure applied state.

The pressure control lever 11 further turns in the forward rotational direction so as to enter the state as shown in FIG. 4 (t13 in FIG. 6A). In this state, the tip of the pressure control lever projecting portion 14 of the pressure control lever 11 is pressing the surface of the holder upper portion piece 4 of the pressure roller holder 2. Due to this pressure, the pressure roller holder 2 is slightly pressed backward so that the pressure applied by the pressure roller 30 with respect to the heat roller 20 is reduced; thus, the fixing apparatus 1 enters the pressure cancelled state.

In this state, the sensor 16 receives reflected light from the sensor light reflection piece 15 of the pressure control lever 11 so that the sensor output reaches the "H level". Then, when a certain time period (Tc in FIG. 6C) elapses from when the sensor output reaches the "H level", the control unit stops the pressure control lever drive motor so as to stop the pressure control lever 11 (t14 in FIG. 6A).

Until entering such a state (t14 in FIG. 6A), the pressure control lever drive motor rotates forward so that the pressure control lever 11 turns in the forward rotational direction; thus, the fixing apparatus 1 enters the state as shown in FIG. 5. In the state as shown in FIG. 5, the tip of the pressure control lever projecting portion 14 of the pressure control lever 11 is pressing the holder upper portion piece end 5 of the pressure roller holder 2. Thus, the state as shown in FIG. 5 is a state in which the pressure cancelled state is maintained.

Next, when the fixing apparatus 1 is in the pressure cancelled state, pressure application control for shifting from the pressure cancelled state to the pressure applied state will be described. The exact opposite control to the aforementioned pressure cancellation control is performed for such pressure application control. FIG. 5 shows the pressure cancelled state of the fixing apparatus 1.

That is, in this state, the tip of the pressure control lever projecting portion 14 of the pressure control lever 11 is pressing the holder upper portion piece end 5 of the pressure roller holder 2, and the pressure roller holder 2 is slightly pressed backward due to this pressure so that pressure applied by the pressure roller 30 with respect to the heat roller 20 is reduced. The output of the sensor 16 is at the "H level" in this state.

In the pressure cancelled state, the control unit rotates the pressure control lever drive motor backward so as to turn the pressure control lever 11 in the backward rotational direction (the direction opposite to the direction indicated by the arrow 17 in FIG. 1) (t21 in FIG. 7A).

Thereby, the pressure control lever 11 turns in the backward rotational direction so as to enter the state as shown in FIG. 4 (t22 in FIG. 7A). In this state, the tip of the pressure control lever projecting portion 14 of the pressure control lever 11 is pressing the surface of the holder upper portion piece 4 of the pressure roller holder 2 so that the fixing apparatus 1 is still in the pressure cancelled state.

The pressure control lever 11 further turns in the backward rotational direction so as to enter the state as show in FIG. 3 (t23 in FIG. 7A). This state is not a state in which the tip of the pressure control lever projecting portion 14 of the pressure control lever 11 is pressing the surface of the holder upper portion piece 4 of the pressure roller holder 2. Thus, the surface of the holder upper portion piece 4 of the pressure roller holder 2 is not being pressed so that the fixing apparatus 1 enters the pressure applied state.

In this state, the sensor 16 does not receive reflected light from the sensor light reflection piece 15 of the pressure control lever 11 so that the sensor output reaches the "L level". Then, when a certain time period (Tc in FIG. 7C) elapses from when the sensor output reaches the "L level", the control unit stops the pressure control lever drive motor so as to stop the pressure control lever 11 (t24 in FIG. 7A).

Until entering such a state (t24 in FIG. 7A), the pressure control lever drive motor rotates backward so that the pressure control lever 11 turns in the backward rotational direction; thus, the fixing apparatus 1 enters the state as shown in FIG. 2. The state as shown in FIG. 2 is not a state in which the tip of the pressure control lever projecting portion 14 of the pressure control lever 11 is pressing the surface of the holder upper portion piece 4 of the pressure roller holder 2 so that the surface of the holder upper portion piece 4 of the pressure roller holder 2 is not being pressed. Thus, the state as shown in FIG. 2 is a state in which the pressure applied state is maintained.

Note that, the length of time between t21 and t24 in FIG. 7A is substantially the same as the length of time between t11 and t14 in FIG. 6A. That is, the necessary time required for pressure cancellation control is substantially as long as the necessary time required for pressure application control.

As for the aforementioned pressure cancelation operation and pressure application operation, the aforementioned fixing apparatus 1 in the present embodiment performs processing using a characteristic method for handling a case in which a failure related to such operations occurs (hereinafter, referred to as pressure failure), specifically, a case in which the pressure control lever 11 and the pressure control lever drive motor that drives the pressure control lever 11 fail (hereinafter, referred to as pressure control mechanism failure) and a case in which the sensor 16 fails (hereinafter, referred to as pressure control sensor failure). Next, description will be given on this point.

In the case of the aforementioned pressure control mechanism failure, the pressure control lever 11 becomes almost inoperative due to a failure of the pressure control lever 11 or the pressure control lever drive motor that drives the pressure control lever 11, or failures of both the pressure control lever 11 and the pressure control lever drive motor. Also, in the case of the aforementioned pressure control sensor failure, the sensor 16 does not operate normally so that the sensor output is not at an appropriate level.

Figures 8A, 8B, 8C:
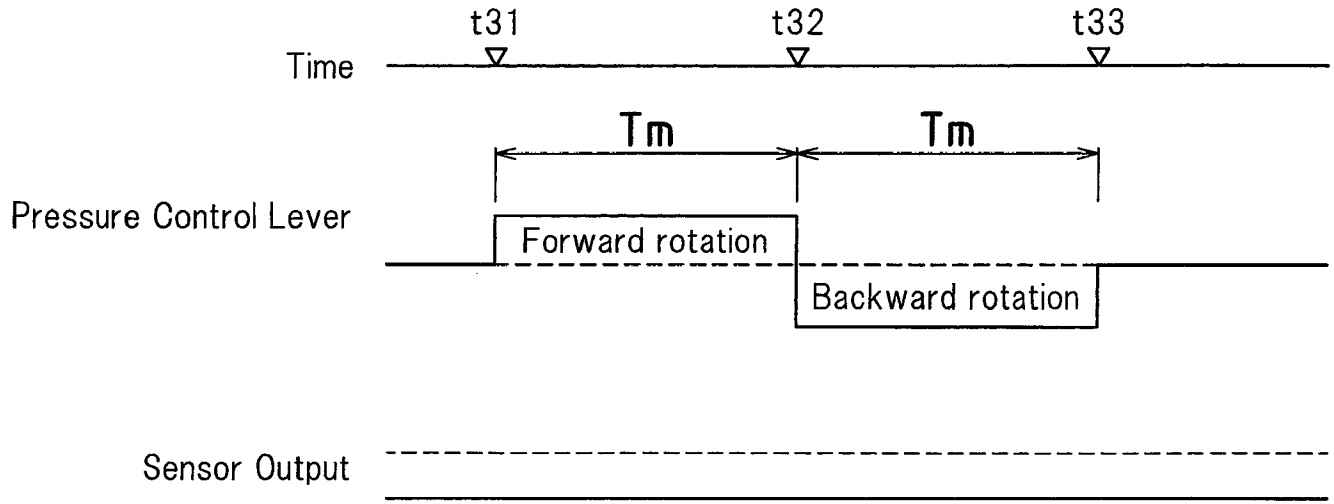
FIGS. 8A, 8B, and 8C is a time chart in a case in which a pressure failure occurs when pressure cancellation control is performed by the fixing apparatus in the embodiment.

Next, the case in which the aforementioned pressure failure occurs when pressure cancellation control for shifting from the pressure applied state to the pressure cancelled state is performed will be described first. FIGS. 8A, 8B, 8C is a time chart showing a case in which a pressure failure occurs when pressure cancellation control is performed.

In the aforementioned fixing apparatus 1, in the case in which a pressure failure occurs when pressure cancellation control is performed, after the control unit starts performing pressure cancellation control with the pressure control lever 11 in the pressure applied state, that is, after the control unit starts turning the pressure control lever 11 in the forward rotational direction (t31 in FIG. 8A), if the turning in the forward rotational direction is continued for a certain time period (Tm in FIG. 8B), but the sensor output of the sensor 16 does not reach the "H level", that is, the sensor 16 does not detect the pressure cancelled state (t32 in FIG. 8A), the control unit determines that a pressure cancellation failure has occurred.

In this state, the control unit immediately performs pressure application control. That is, the control unit performs an operation of turning the pressure control lever 11 in the backward rotational direction for a certain time period (Tm in FIG. 8B) (t32 in FIG. 8A), and stops turning the pressure control lever 11 in the backward rotational direction (t33 in FIG. 8A) after the certain time period (Tm in FIG. 8B) has elapsed.

Thereafter, the control unit does not stop operations in the fixing apparatus 1 and permits a fixing operation in only the pressure applied state. Then, the control unit outputs information indicating "a failure occurred" and "a fixing operation can be performed in only the pressure applied state".

In the case in which a pressure failure occurs when the aforementioned pressure cancellation control is performed, if the sensor output of the sensor 16 does not reach the "H level", that is, the sensor 16 does not detect the pressure cancelled state even when the control unit has performed pressure cancellation control for a certain time period with respect to the pressure control lever 11 in the pressure applied state, the control unit determines that a pressure cancellation failure has occurred; however, the control unit permits a fixing operation in only the pressure applied state after performing pressure application control for a certain time period (Tm in FIG. 8B) with respect to the pressure control lever 11. The following are the reasons why the above operation is permitted in only such a state.

If the sensor output of the sensor 16 does not reach the "H level", that is, the sensor 16 does not detect the pressure cancelled state even when the control unit performed pressure cancellation control for a certain time period (Tm in FIG. 8B) with respect to the pressure control lever 11 in the pressure applied state, such a case is, as described above, a case of a pressure failure, that is, a pressure control mechanism failure (the case in which the pressure control lever 11 or the pressure control lever drive motor that drives the pressure control lever 11 fails) or a detection failure in the sensor 16 (a pressure control sensor failure), or the case in which both the pressure control mechanism and the sensor 16 fail.

First, the case of the aforementioned pressure control mechanism failure will be described. In this case, although the sensor 16 is normal, the pressure control mechanism does not operate; thus, even when the control unit performed pressure cancellation control for a certain time period (Tm), the pressure control mechanism remains in the pressure applied state and cannot shift to the pressure cancelled state. As a result of this, the sensor 16 is normal, but cannot detect the pressure cancelled state of the pressure control mechanism.

That is, since the pressure control lever 11 does not operate in this case, even if the control unit performs pressure cancellation control for substantially the same time period, from starting to perform pressure cancellation control, as the aforementioned certain time period (Tm in FIG. 8B), the pressure control lever 11 does not operate and remains in the pressure applied state. Since the pressure roller 30 remains pressing against the heat roller 20 in this case, the aforementioned fixing apparatus 1 can perform a fixing operation.

Note that, the aforementioned certain time period (Tm in FIG. 8B) is substantially as long as the time between t11 and t14 in FIG. 6A described above or the time between t21 and t24 in FIG. 7A described above.

Next, the case of a pressure control sensor failure, that is, a detection failure in the sensor 16 will be described. In this case, the pressure control mechanism is normal. Thus, in this case, although the pressure control lever 11 operates and enters the pressure cancelled state, the pressure cancelled state cannot be detected because the sensor 16 fails to detect it.

Since the pressure control lever 11 operates in this case, if the control unit continuously performs pressure application control for a time period that is substantially as long as the aforementioned certain time period (Tm in FIG. 8B) after performing pressure cancellation control, the pressure control lever 11 returns to the pressure applied state that was the previous state thereof. In this case, the state returns to a state in which the pressure roller 30 presses against the heat roller 20; thus, the aforementioned fixing apparatus 1 can perform a fixing operation.

Next, a case in which both of the aforementioned pressure control mechanism failure and a pressure control sensor failure are concurrently occurring will be described. In this case, since the pressure control lever 11 does not operate, even when the control unit performed pressure cancellation control for a certain time period (Tm in FIG. 8B), the pressure control lever 11 remains in the pressure applied state and cannot shift to the pressure cancelled state. Also, the pressure cancelled state is not detected because the sensor 16 fails to detect it.

That is, this case is the same as the case of the aforementioned pressure control mechanism failure because the pressure control lever 11 does not operate. Accordingly, even if the control unit performs pressure cancellation control for substantially the same time period, from starting to perform pressure cancellation control, as the aforementioned certain time period (Tm in FIG. 8B), the pressure control lever 11 remains in the pressure applied state. Consequently, in this case, the pressure roller 30 remains pressing against the heat roller 20; thus, the aforementioned fixing apparatus 1 can perform a fixing operation.

Figures 9A, 9B, 9C:
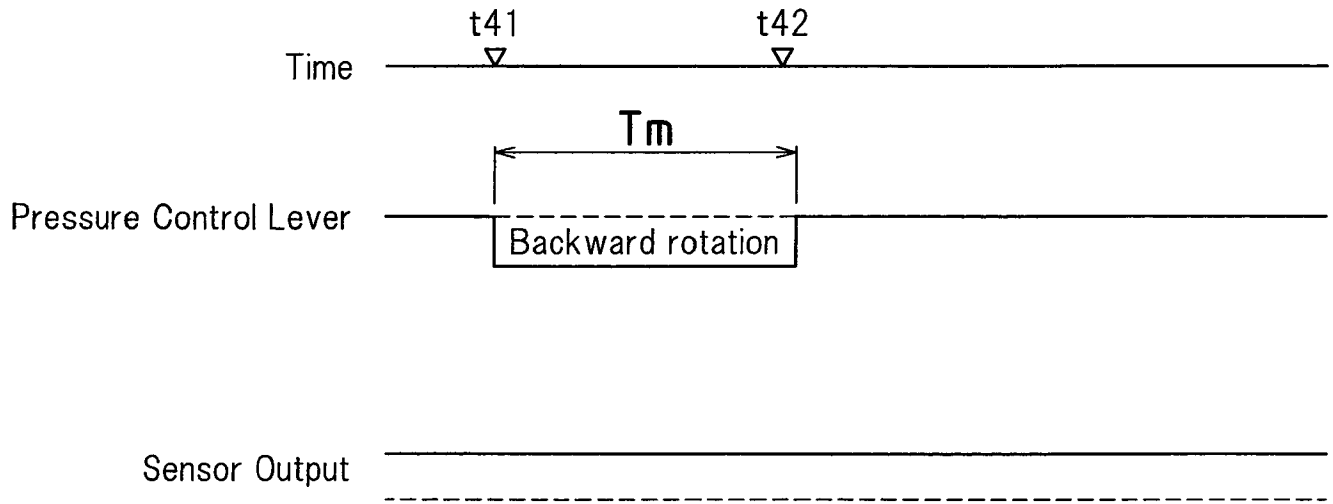
FIGS. 9A, 9B, and 9C is a time chart in a case in which a pressure failure occurs when pressure application control is performed by the fixing apparatus in the embodiment.

Next, a case in which the aforementioned pressure failure occurs when pressure application control for shifting from the pressure cancelled state to the pressure applied state is performed will be described. FIGS. 9A, 9B, 9C is a time chart showing a case in which a pressure failure occurs when pressure application control is performed.

In the aforementioned fixing apparatus 1, in the case in which a pressure failure occurs when pressure application control is performed, after the control unit starts performing pressure application control with the pressure control lever 11 in the pressure cancelled state, that is, after the control unit starts turning the pressure control lever 11 in the backward rotational direction (t41 in FIG. 9A), if this pressure application control is performed for a certain time period (Tm in FIG. 9B), but the sensor output of the sensor 16 does not reach the "L level", that is, the sensor 16 does not detect the pressure applied state (t42 in FIG. 9A), the control unit determines that a pressure application failure has occurred and immediately stops operations in the fixing apparatus 1.

Thereafter, the control unit outputs information indicating "a failure occurred" and "a fixing operation cannot be performed".

In the aforementioned case, if the sensor output of the sensor 16 does not reach the "L level", that is, the sensor 16 does not detect the pressure applied state even when the control unit performed pressure application control for a certain time period with respect to the pressure control lever 11 in the pressure cancelled state, such a case is, as described above, a case of a pressure failure, that is, a pressure control mechanism failure (the case in which the pressure control lever 11 or the pressure control lever drive motor that drives the pressure control lever 11 fails) or a detection failure in the sensor 16 (a pressure control sensor failure), or the case in which both of the pressure control mechanism and the sensor 16 fail.

First, when the pressure control sensor failure, that is, a failure due to a detection failure of the sensor 16 occurs, the pressure control mechanism is normal in this case. Accordingly, the control unit can cause the pressure control lever 11 to enter the pressure applied state by performing pressure application control for a certain time period (Tm in FIG. 9B) with respect to the pressure control lever 11. In this case, the pressure roller 30 definitely presses against the heat roller 20; thus, the aforementioned fixing apparatus 1 can perform a fixing operation.

However, in the case of a pressure control mechanism failure, although the sensor 16 is normal, the pressure control mechanism does not operate. Accordingly, even when the control unit has performed pressure application control for a certain time period (Tm in FIG. 9B), the pressure control lever 11 remains in the pressure cancelled state and cannot shift to the pressure applied state. Consequently, the sensor 16 is normal, but cannot detect the pressure applied state of the pressure control lever 11.

That is, in this case, since the pressure control lever 11 does not operate, the pressure control lever 11 remains in the pressure cancelled state even after the control unit performs pressure application control. Accordingly, in this case, the pressure roller 30 does not press against the heat roller 20; thus, the aforementioned fixing apparatus 1 cannot perform a fixing operation.

That is, if the sensor 16 fails to detect it, but the pressure control mechanism is normal, the control unit can cause the pressure control lever 11 to enter the pressure applied state by performing pressure application control for a certain time period (Tm in FIG. 9B) with respect to the pressure control lever 11. Thus, a fixing operation can be performed in this case. However, in the case of a pressure control mechanism failure, since the pressure control lever 11 does not operate, the pressure control lever 11 remains in the pressure cancelled state no matter what processing the control unit performs. Consequently, the fixing apparatus 1 cannot perform a fixing operation in this case.

However, in the above case, the control unit cannot determine which case is occurring, that is, whether the sensor 16 fails to detect it although the pressure control mechanism is normal, or the pressure control mechanism fails. Therefore, in the aforementioned case in which the sensor 16 does not detect the pressure applied state even when the control unit performed pressure application control for a certain time period (Tm in FIG. 9B) with respect to the pressure control lever 11 in the pressure cancelled state, the control unit determines that a pressure application failure has occurred and does not permit a fixing operation as a precaution. That is the only method for handling such a case. Therefore, the control unit determines that a pressure application failure has occurred and does not permit a fixing operation.

According to the aforementioned fixing apparatus 1 in the present embodiment, if the sensor 16 does not detect the pressure cancelled state even when pressure cancellation control was performed for a certain time period with respect to the pressure control lever 11 in the pressure applied state, it is determined that a pressure cancellation failure has occurred; however, a fixing operation in only the pressure applied state is permitted after pressure application control is performed for a certain time period with respect to the pressure control lever 11. Accordingly, even when it is determined that a pressure cancellation failure has occurred in the fixing apparatus 1, a fixing operation can be performed.

Whereas, if the sensor 16 does not detect the pressure applied state even when pressure application control was performed for a certain time period with respect to the pressure control lever 11 in the pressure cancelled state, it is determined that a pressure application failure has occurred, and a fixing operation is not permitted. Then, operations are stopped. Accordingly, a case in which it is determined that a pressure application failure has occurred in the fixing apparatus 1 can be reliably determined as a case in which a fixing operation cannot be performed.

Therefore, the convenience for a user of an image forming apparatus or the like including the fixing apparatus 1 as a constituent element can be increased.

Further, according to the fixing apparatus 1 in the aforementioned present embodiment, on determining the occurrence of a pressure cancellation failure, the control unit outputs information indicating that "a failure occurred" and "a fixing operation can be performed in only the pressure applied state". Meanwhile, on determining the occurrence of a pressure application failure, the control unit outputs information indicating that "a failure occurred" and "a fixing operation cannot be performed".

Accordingly, as for an image forming apparatus or the like including the fixing apparatus 1 as a constituent element, based on the aforementioned information, the user of this image forming apparatus or the like can be notified with the exact information regarding the state of the image forming apparatus or the like. Further, the user can request a store or the like that sold the image forming apparatus to send maintenance personnel, or the like. Therefore, the convenience for the user of the image forming apparatus or the like including the aforementioned fixing apparatus 1 as a constituent element can be increased.

In the aforementioned fixing apparatus 1 in the present embodiment, with respect to the pressure control lever 11, when pressure cancellation control for shifting from the pressure applied state to the pressure cancelled state is performed, the pressure control lever drive motor is caused to rotate forward so as to turn the pressure control lever 11 in the forward rotational direction, and when pressure application control for shifting from the pressure cancelled state to the pressure applied state is performed, the pressure control lever drive motor is caused to rotate backward so as to turn the pressure control lever 11 in the backward rotational direction.

However, the method for performing pressure cancellation control and pressure application control with respect to the pressure control lever 11 is not limited to the above method. Both pressure cancellation control and pressure application control may be performed by rotating the pressure control lever drive motor in the same direction.

The shape of the pressure control lever in this case is assumed to be a shape of a cam with which the pressure cancelation operation can be performed by turning the pressure control lever a half turn, and the pressure application operation can be performed by turning the pressure control lever the remaining half turn.

It should be noted that the present invention may be embodied in various other forms without departing from the spirit or essential characteristics thereof. The aforementioned embodiments disclosed in this application are to be considered in all respects as merely illustrative and not limiting. The scope of the present invention is indicated by the appended claims rather than by the foregoing description, and all modifications or changes that come within the meaning and range of equivalency of the claims are intended to be embraced therein.

What is claimed is:

1. A fixing apparatus that causes a recording material to pass through a nip portion formed by a rotating heat roller and a rotating pressure roller being in contact so as to perform a fixing operation to fix an unfixed image on the recording material, the apparatus comprising:

a pressing mechanism that can switch between a pressure applied state in which a pressure roller presses against a heat roller using a bias and a pressure cancelled state in which the pressure is cancelled;

a pressure state detection unit that detects the pressure applied state and the pressure cancelled state; and a control unit that performs pressure cancellation control, with respect to the pressing mechanism in the pressure applied state, for shifting from the pressure applied state to the pressure cancelled state within a certain time period and pressure application control, with respect to the pressing mechanism in the pressure cancelled state, for shifting from the pressure cancelled state to the pressure applied state within substantially the certain time period, wherein the control unit is configured to detect that a pressure cancellation failure has occurred when the pressure state detection unit does not detect the pressure cancelled state even when the control unit has performed the pressure cancellation control for the certain time period with respect to the pressing mechanism in the pressure applied state, and the control unit is further configured to perform the pressure application control for substantially the certain time period with respect to the pressing mechanism after the pressure cancellation failure is detected to permit the fixing operation in only the pressure applied state.

2. The fixing apparatus according to claim 1, wherein the control unit is further configured to output information indicating that a failure has occurred and the fixing operation can be performed in only the pressure applied state on determining that the pressure cancellation failure has occurred.

3. The fixing apparatus according to claim 2, wherein the control unit is further configured to determine that a pressure application failure has occurred and does not permit the fixing operation where the pressure state detection unit does not detect the pressure applied state even when the control unit has performed the pressure application control for substantially the certain time period with respect to the pressing mechanism in the pressure cancelled state.

4. The fixing apparatus according to claim 3, wherein the control unit is further configured to output information indicating that a failure has occurred and the fixing operation cannot be performed on determining that the pressure application failure has occurred.

5. The fixing apparatus according to claim 1, wherein the control unit is further configured to determine that a pressure application failure has occurred and does not permit the fixing operation where the pressure state detection unit does not detect the pressure applied state even when the control unit has performed the pressure application control for substantially the certain time period with respect to the pressing mechanism in the pressure cancelled state.

6. The fixing apparatus according to claim 5, wherein the control unit is further configured to output information indicating that a failure has occurred and the fixing operation cannot be performed on determining that the pressure application failure has occurred.

* * * * *